United States Patent [19]

Luckenbach

[11] 4,327,344

[45] Apr. 27, 1982

[54] SOLENOID WITH MECHANICALLY LATCHABLE PLUNGER

[75] Inventor: David Luckenbach, West Haven, Conn.

[73] Assignee: Hi-G Incorporated, Windsor Locks, Conn.

[21] Appl. No.: 135,879

[22] Filed: Mar. 31, 1980

[51] Int. Cl.[3] ..... H01F 7/08

[52] U.S. Cl. ..... 335/253; 335/254

[58] Field of Search ..... 335/253, 254, 255, 258, 335/261, 274

[56] References Cited

U.S. PATENT DOCUMENTS

| | | | |
|---|---|---|---|
| 2,340,092 | 1/1944 | Wells | 335/253 |
| 2,370,038 | 2/1945 | Iglehart | 335/253 |
| 2,515,258 | 7/1950 | O'Brien et al. | 335/253 |
| 2,515,259 | 7/1950 | O'Brien et al. | 335/253 |
| 3,307,131 | 2/1967 | Hook et al. | 335/253 |
| 3,689,857 | 9/1972 | Obszarny | 335/253 |
| 3,735,296 | 5/1973 | Obszarny | 335/253 |

FOREIGN PATENT DOCUMENTS

| | | | |
|---|---|---|---|
| 844337 | 8/1960 | United Kingdom | 335/253 |

*Primary Examiner*—George Harris

*Attorney, Agent, or Firm*—Hayes & Reinsmith

[57] ABSTRACT

A mechanically latchable solenoid having a single coil and a single-piece armature or core plunger having a latch pin fixed thereto. The plunger is moved to a first, retracted position by energization of the coil with a pulse of either direct or alternating electric current. A spring-biased mechanical latch latches the plunger in the retracted position. A subsequent energization of the coil with a current pulse unlatches the plunger so that the plunger is returned to its original, unretracted position by a non-magnetic external force, such as that provided by a plunger spring. The latch is in the form of a lobed cam which is mechanically moved out of its normal unlatched position by the latch pin when the coil is first energized to attract the plunger from its unretracted to its retracted position. When the plunger has moved a predetermined portion of the distance to its retracted position, a lobe of the spring-biased cam engages the pin to prevent the plunger from returning to its original position. However, upon the subsequent energization of the coil, the plunger is again moved toward the retracted position to release the latch pin from the lobe and unlatch the plunger, thereby permitting the plunger to be returned to its original unretracted position when the coil is again de-energized.

10 Claims, 16 Drawing Figures

SOLENOID WITH MECHANICALLY LATCHABLE PLUNGER

BACKGROUND OF THE INVENTION

1. Field of the Invention

This invention relates to the field of solenoids having a core or armature plunger and means for latching the plunger in its energized position so that the plunger will remain there when the solenoid is de-energized, and, more particularly, to an improved solenoid assembly wherein the plunger is both latched and unlatched by application of current pulses and in which the latching mechanism itself is operated by a strictly mechanical, non-magnetic means.

2. Description of the Prior Art

Core-plunger solenoids of the latching type are broadly well-known. More specifically, it is generally known to provide a means for latching a core-plunger in its energized or retracted position so that the plunger will remain in that position when the solenoid is de-energized. Various means are then provided for unlatching the plunger upon the next energization of the solenoid so that the plunger can be returned to its unenergized or unretracted position. However, such prior art latching mechanisms either include a magnetizable element controlled by the magnetic field, two oppositely-wound solenoid coils which must be energized in sequence to perform the latching and unlatching functions, means for energizing the solenoid with successive current pulses of opposite polarities to perform the latching and unlatching functions, plungers having two separate plunger sections which are separated by a spring, or latch means external to the plunger itself for latching switch contacts and wherein the plunger returns to its unretracted position upon each de-energization of the solenoid. Such prior art devices are disclosed, for example, in the following U.S. Pat. Nos. 2,340,092, 2,448,959, 2,515,258, 2,515,259, 2,885,606, 3,290,631, 3,307,131, 3,689,857, 3,735,296, 3,895,331, 3,983,520 and 4,078,709.

SUMMARY OF THE INVENTION

Thus, the broad object of this invention is to provide an improved solenoid of the latchable plunger type wherein the structure of a mechanical latching means is simplified and compact and the operation thereof is achieved by strictly mechanical, non-magnetic forces.

Another object of the invention is to provide such a solenoid having a single-piece core or armature plunger and only a single solenoid coil which can be energized by either A.C. or D.C. for both latching and unlatching the core plunger itself on successive energizations of the solenoid.

More specifically, the object is to provide such a solenoid with a latching mechanism consisting of a Z-cam latch which will provide the desired latching and unlatching functions by mechanical interaction with a latch pin fixed to the core plunger.

DETAILED DESCRIPTION OF THE PREFERRED EMBODIMENT

Figure 2:
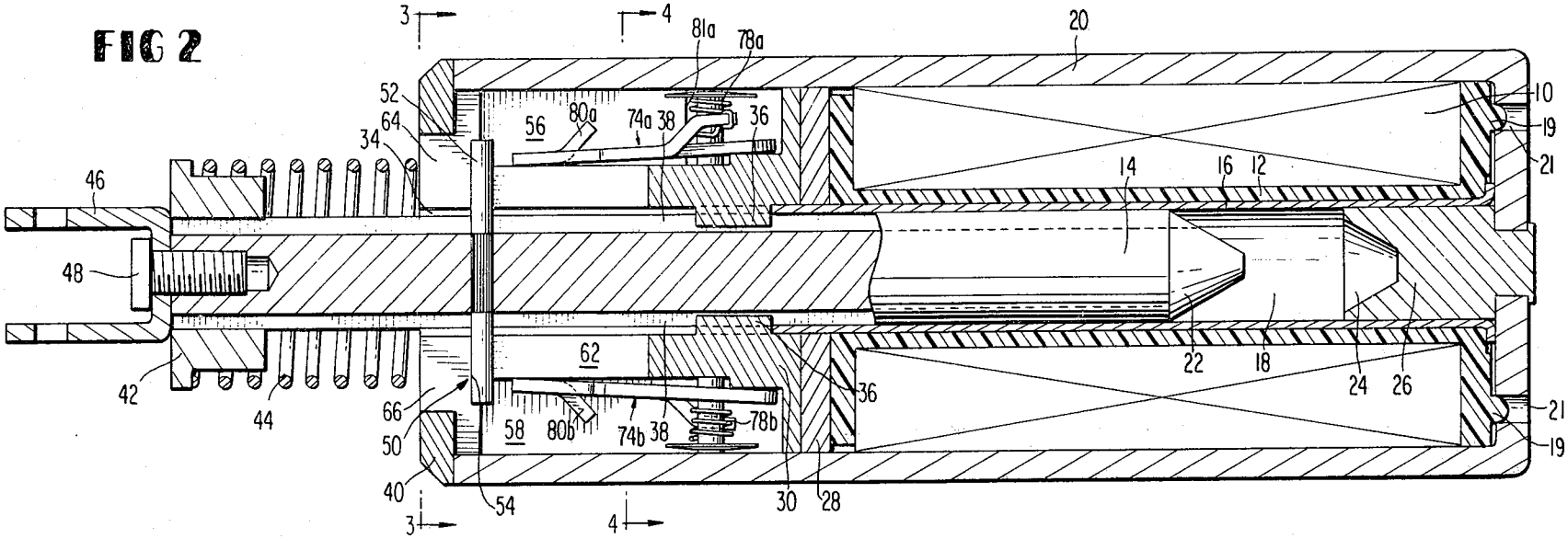
FIG. 2 is a cross-sectional view taken along line 2—2 of FIG. 1.
Figure 1:
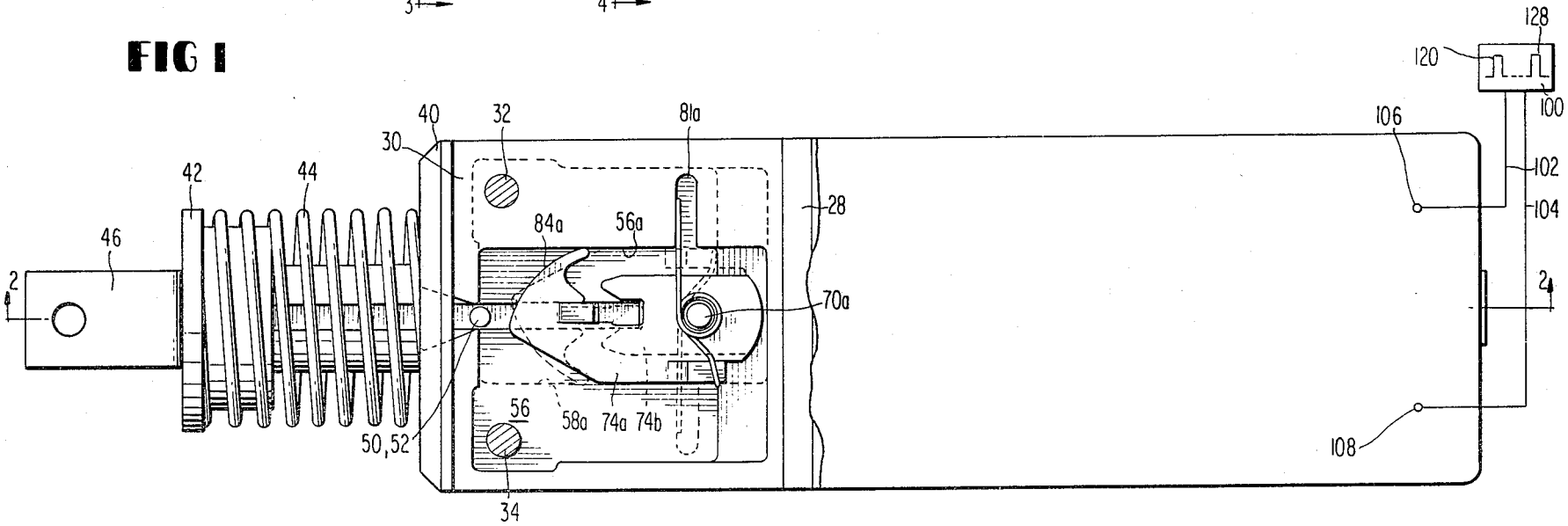
FIG. 1 is a partially cut-away plan view of the preferred embodiment of the improved solenoid assembly.

FIGS. 1 and 2 illustrate a preferred embodiment of the complete improved solenoid assembly including the means for mechanically latching the core plunger. The basic solenoid and plunger assembly itself is conventional and consists essentially of a cylindrical solenoid or coil 10 wound on a bobbin 12. The cylindrical magnetic core or armature plunger 14 is slidably mounted for reciprocal movement in a tubular guide 16 lining the central bore 18 of the solenoid coil 10. The solenoid is mounted in a magnetic frame 20 and locked therein by projections 19 which fit into openings 21. The inner or righthand end 22 (as viewed in FIG. 2) of plunger 14 has the configuration of a truncated cone and is adapted to seat in the similarly configured recess 24 in the stop member 26 located at the righthand end of the guide 16 and secured to the frame 20. A magnetic flux washer 28 surrounds the guide 16 at the lefthand end thereof and is fixed to the frame 20. A latch block 30 is fixed to the lefthand end of frame 20 by suitable fastening means, such as screws 32 and 34. Block 30 has a central bore 35 which is coextensive with that of tubular guide 16. Formed in the righthand end of the bore 35 of block 30 are inwardly projecting ribs 36 which fit into corresponding grooves 38 in the plunger 14 to prevent rotation of the plunger.

Mounted between the end cap 40 of block 30 and a flanged retainer 42 fixed to the lefthand end of the plunger 14 is a compression spring 44 which biases the plunger to the left, i.e., outwardly from the solenoid to the unretracted, unenergized position of the plunger. This plunger return spring may be replaced by any other suitable external force for returning the plunger to its unretracted position in order to operate the latch as will be described in more detail below.

A yoke 46 is fixed to the lefthand end of plunger 14 by suitable fastening means, such as the bolt 48. This yoke may be fixed to a suitable utilization means designed to be operated by any electromagnetic linear actuator. The leftward displacement of plunger 14 is determined by the requirement of the particular utilization means.

A non-magnetic splined latch pin 50 is press fit into the plunger 14 through a diameter thereof so that the opposite pin ends 52 and 54 project radially outwardly from plunger 14 at diametrically opposite points into corresponding complementary latch cavities 56 and 58 in the latch block 30. The ends 52 and 54 of the latch pin 50 travel in corresponding guide slots 60 and 62 formed in the latch block 30 and extend through the slots into the cavities 56 and 58, respectively. The guide slots 60 and 62 have flared openings 64 and 66, respectively, which begin at the left-hand end of the latch block 30 and extend through the end cap 40 thereof.

Figure 5:
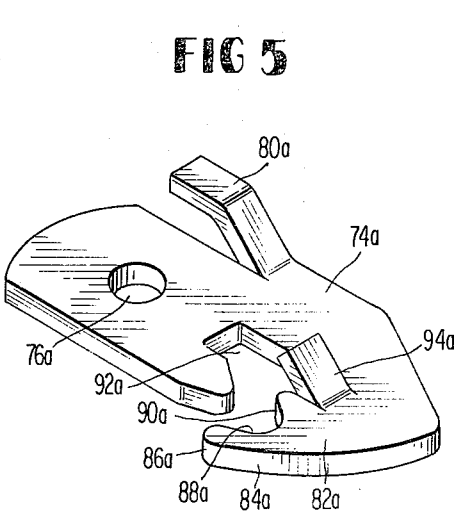
FIG. 5 is a perspective view of the preferred embodiment of the mechanical cam-latch of this invention.
Figure 4:
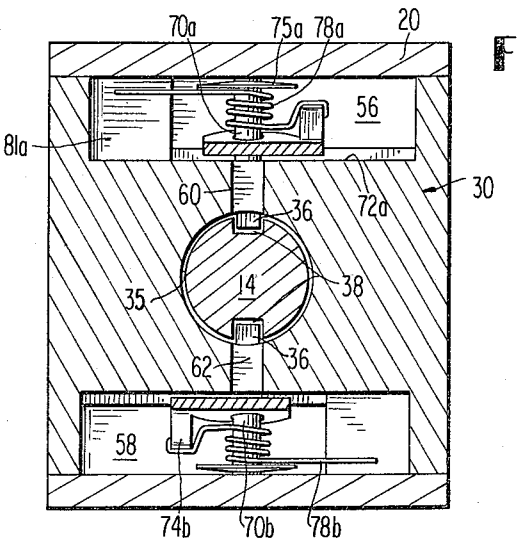
FIG. 4 is a cross-sectional view taken along line 4—4 of FIG. 2.
Figure 3:
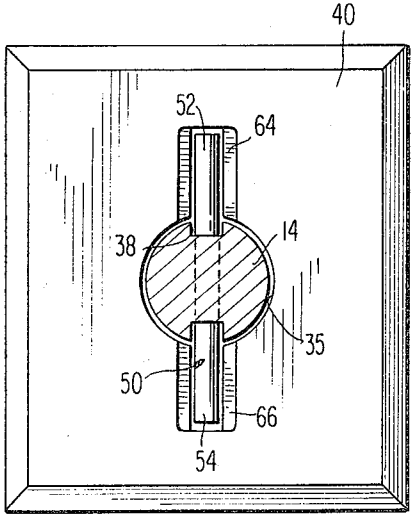
FIG. 3 is cross-sectional view taken along line 3—3 of FIG. 1.

Let us now look at the latch cavity 56 as shown in FIGS. 1, 2 and 4. A pivot pin 70*a* is fixed to the surface 72*a* of block 30 and extends outwardly toward the frame 20. A spring retaining disc 75*a* is fixed to the outer end of the pin. A Z-cam latch plate 74*a* is pivotably mounted via the hole 76*a* for rotation about the pivot pin. The cam plate 74*a* is biased in the clockwise position (FIG. 1) and inwardly toward plunger 14 by means of a torsion-compression spring 78*a* whose opposite ends are respectively anchored to the tang 80*a* struck out of the surface of the cam plate 74*a* and in the spring retaining slot 81*a* formed in the latch block 30. As shown in FIG. 5, the cam plate 74*a* also has a lobe 82*a* having a camming surface 84*a* terminating in a finger 86*a*. Formed in the finger is a lobe recess 88*a* terminating in a shoulder 90*a*. The cam plate also has a slot 92*a* and a camming tab 94*a* struck out of the surface of the cam plate. The latching mechanism in cavity 58 is identical to that in cavity 56 except that the cam plates 74*a* and 74*b* are mounted for corresponding rotations in opposite directions within the complementary cavities 56 and 58. The corresponding elements in cavity 58 carry the same reference numerals but with a subscript b. As indicated in FIGS. 2 and 4, the cavities 56 and 58 are of identical shape but are reversed with respect to each other, the identical cam plates 74*a* and 74*b* are mounted so that they are upside down with respect to each other, and the rotational biases provided by the springs 78*a* and 78*b* are in opposite directions.

As schematically shown in FIG. 1, a suitable current pulse source 100 is connected via leads 102 and 104 to terminals 106 and 108, respectively, which are electrically connected across the solenoid coil 10 for energizing the coil with current pulses. However, the operation of plunger 14 is independent of the polarity of the coil energizing current, and, thus, the current pulses may be either polarity and either A.C. or D.C.

The operation of the preferred embodiment of the improved mechanically latchable solenoid will now be described with reference to FIGS. 1, 2, 4 and 6–11A.

First, let us assume that the latchable solenoid assembly is in its unretracted, unenergized position as shown in FIGS. 1, 2, and 4. Thus, the two cam plates 74*a* and 74*b* are biased in opposite directions by their respective springs 78*a* and 78*b* to the unlatched or horizontal position of the cam plates. It should be noted that when cam plates 74*a* and 74*b* assume the unlatched position shown in FIG. 1, the tips of fingers 86*a* and 86*b* engage the sidewalls 56*a* and 58*a* of cavities 56 and 58, respectively. Let us now assume that the solenoid is first energized by current in the form of the pulse 120 from the source 100. The single-piece magnetic core plunger 14 is then magnetically attracted into the solenoid toward the stop member 26 against the bias of the plunger spring 44. We will look at the operation of the cam plate 74*a*, remembering that the operation of the opposite cam plate 74*b* is identical but that corresponding rotations of the two cam plates occur in opposite directions.

Figure 8:
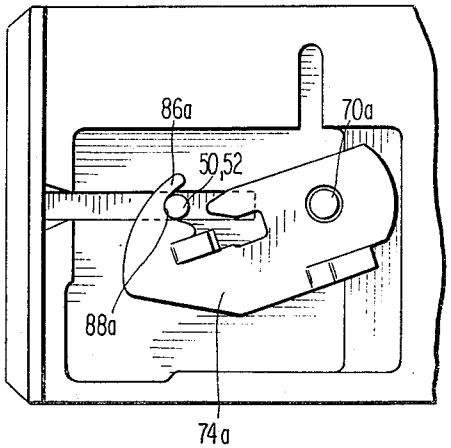
FIGS. 6, 7 and 8 are plan views of the latch block of FIG. 1 and show sequential positions of the latch and latch pin as the plunger moves from its unenergized, unretracted position to its unenergized, latched position.
Figure 7:
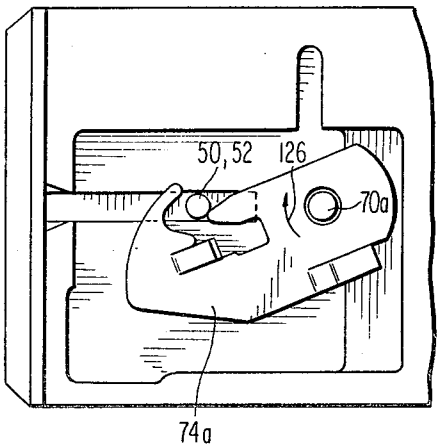
Figure 6:
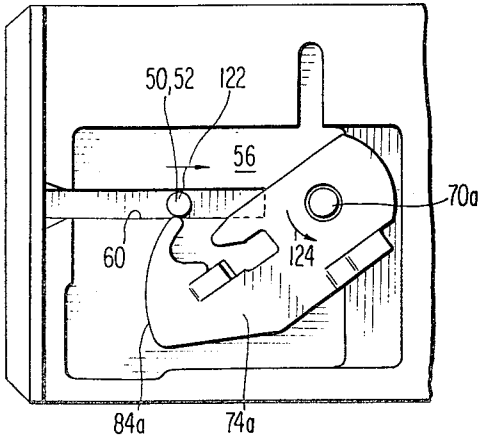

As plunger 14 is attracted into the solenoid toward the retracted position, the end 52 of latch pin 50 moves in the same direction as indicated by the arrow 122 and engages the cam surface 84*a* of the cam plate 74*a*. Cam plate 74*a* is thus cammed in the counterclockwise direction (arrow 124) against the bias of the cam plate spring 78*a*. As the latch pin 50 rides over the cam surface toward the tip of the lobe finger 86*a*, the cam plate reaches its cocked position as shown in FIG. 6. As the plunger continues to move in the same direction, the latch pin rides over the tip of finger 86*a*, permitting the cam plate 74*a* to be rotated in the clockwise direction 126 toward its latched position as shown in FIG. 7. When the inward end 22 of plunger 14 strikes the stop member 26, the solenoid is de-energized by terminating the current pulse 120, whereupon the cam plate 74*a* completes its clockwise movement until the recess 88*a* of lobe 82*a* engages the returning latch pin 50, thereby latching the plunger its against further movement by the force of the plunger spring 44, as shown in FIG. 8.

Figure 10:
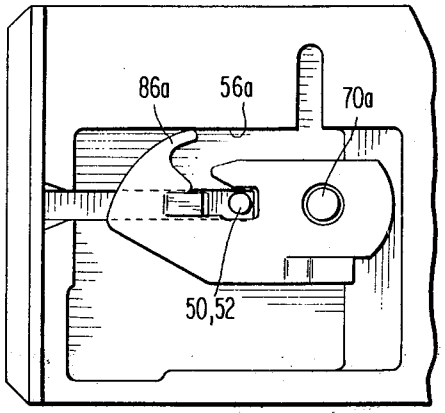
Figure 10A:
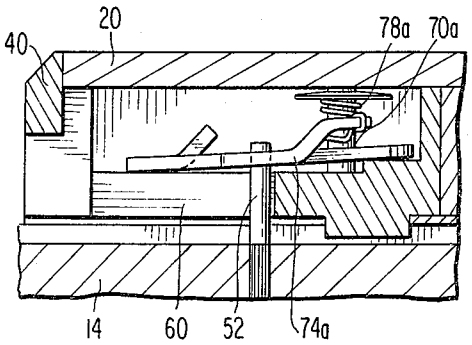
Figure 9:
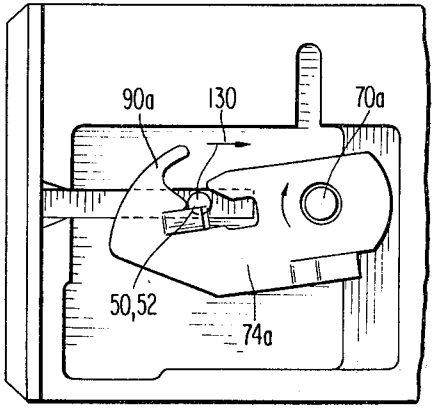
Figure 9A:
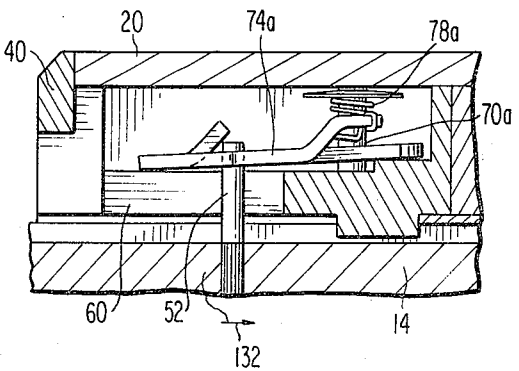

When it is desired to unlatch the plunger and return it to its unretracted position as shown in FIGS. 1 and 2, the solenoid is again energized with electric current in the form of a second pulse 128. Thus, and as shown in FIGS. 9 and 9A, the plunger is again magnetically attracted toward the stop member 26 and away from the latched position of the plunger in the direction indicated by arrows 130 and 132 to cause the latch pin 50 to ride over the lobe shoulder 90*a* and into the slot 92*a* of the cam plate 74*a*. The plunger continues moving in the same direction until the plunger end 22 again bottoms against the stop member 26 to place the latch pin 50 in the position as shown in FIG. 10, so that the cam plate 74*a* is again returned under the bias of its spring to its unlatched, horizontal position as shown in FIGS. 10, 1 and 2.

Figure 11:
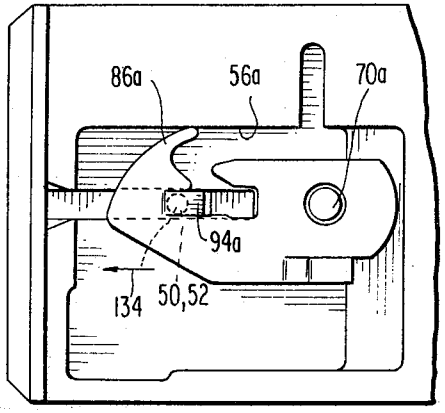
FIGS. 9, 10 and 11 are plan views of the latch block of FIG. 1 and show sequential positions of the latch and plunger as the plunger returns from its energized, unlatched position to its unenergized, unretracted position.
Figure 11A:
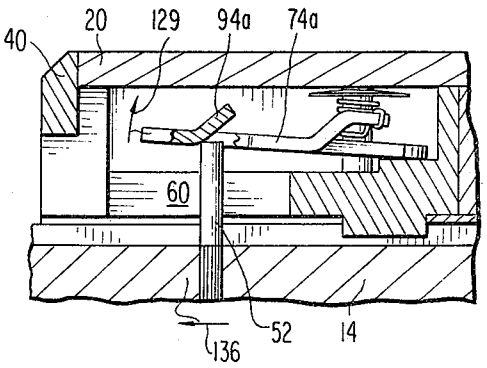
FIGS. 9A, 10A and 11A show portions of the sectional view of FIG. 2 and correspond to the sequential positions of FIGS. 9, 10 and 11, respectively.

At this time, the solenoid coil is again de-energized by the termination of the current pulse 128. Thus, the plunger moves in the direction of arrows 134 and 136 by the force of the plunger spring 44 towards the unretracted, unenergized position of the plunger as shown in FIGS. 1 and 2. As shown in FIGS. 11 and 11A, the latch pin 50 engages the inclined surface of the tab 94*a*, thereby pivoting the cam plate 74*a* outwardly from the core plunger in the direction indicated by arrow 129. Thus, the latch pin escapes from the cam plate 74*a* and travels in the slot 60 in the latch block 30 to the unretracted position shown in FIGS. 1 and 2. The amount of displacement of the plunger in this direction is determined by external means, such as a utilization means which may be connected to yoke 46.

Figure 12:
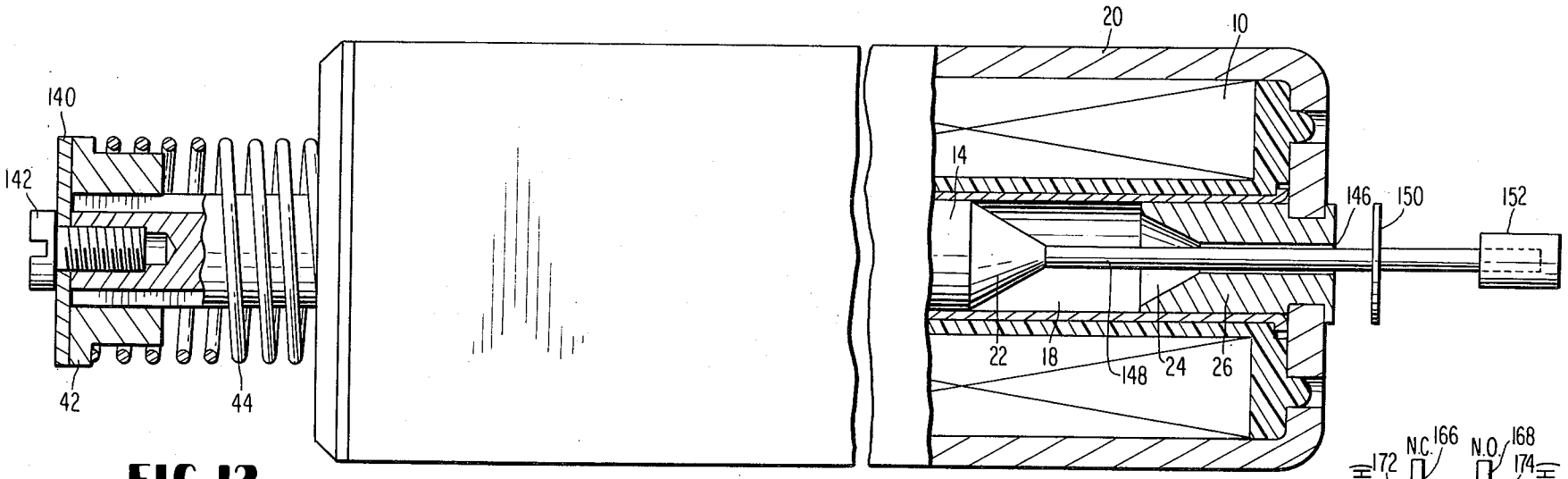
FIG. 12 is a partially cut-away plan view of a second embodiment of the improved solenoid assembly illustrated in FIG. 2.

FIG. 12 is similar to FIG. 2 but illustrates a second embodiment of the invention in the form of a push-type solenoid assembly. The yoke 46 of FIG. 2 has been replaced by a washer 140, and the bolt 48 has been replaced by a screw 142 which secures the washer to the flanged retainer 42, thereby retaining the spring 44 in place.

At the opposite end of the solenoid assembly, the stop member 26 has a central bore 146 formed therein. A push rod 148 is fixed to the end 22 of the plunger 14 and extends through the bore 146 to the exterior of the solenoid assembly. A snap ring 150 is secured to the exterior portion of push rod 148 and functions to limit the leftward movement of plunger 14 as viewed in FIG.

unlatched position under the force of the spring bias whereby, upon the next de-energization of said solenoid coil, said plunger is returned to its unretracted position by said external means.

2. A solenoid assembly as defined in claim 1, wherein said external means comprises plunger spring means mounted on said solenoid assembly and in engagement with said plunger.

3. A mechanically latchable solenoid assembly comprising:

a frame;

a single cylindrical solenoid mounted in the housing and having a central cylindrical bore;

a cylindrical magnetic single-piece core plunger movable along the longitudinal axis of said bore between an unretracted position and a retracted position;

plunger spring means mounted on said housing in engagement with said plunger for mechanically biasing said plunger in a first direction toward said unretracted position;

a latch pin fixed to said plunger and projecting radially outwardly therefrom;

spring-biased first cam latch means mounted on said frame in the path of movement of said latch pin for engaging said latch pin, said latch means being fixed against translational movement along the axis of said bore;

first latch spring means for biasing said latch means to an unlatched position when said solenoid is unenergized and said plunger is in said unretracted position;

said latch means having a cam surface mechanically engageable by said latch pin as said plunger moves in a direction opposite said first direction from said unretracted to said retracted position;

said latch means having a lobe for engaging said latch pin and blocking said plunger against movement in the first direction from said retracted to said unretracted position;

a finger on said lobe;

said latch means having a slot for receiving said latch pin, said slot being parallel to the longitudinal axis of said plunger when said latch means is in said unlatched position;

said plunger being magnetically attracted to move in said opposite direction from said unretracted position to said retracted position when said solenoid is energized with an electric current so that said latch pin moves toward and engages said cam surface to mechanically move said latch means, against the bias of said latch spring means, from said unlatched position to a cocked position beyond a latched position of said latch means, and so that, when said latch pin passes over said finger, said latch spring means returns said latch means from said cocked position to said latched position where said lobe engages said latch pin to latch said plunger against the bias of said plunger spring when said solenoid is de-energized;

said plunger being magnetically attracted again to move in said opposite direction upon a subsequent energization of said solenoid with an electric current whereby said latch pin moves out of engagement with said lobe to permit said latch spring means mechanically to return said latch means to its unlatched position where said latch pin is received in said slot thereby to unlatch said plunger, so that said plunger is returned to said unretracted position by the bias of said plunger spring means when said solenoid is subsequently de-energized.

4. A mechanically latchable solenoid assembly as defined in claim 3 further comprising means on said plunger for preventing rotation thereof about its longitudinal axis.

5. A mechanically latchable solenoid assembly as defined in claim 3, wherein said latch pin has two ends which project radially outward from said plunger at two diametrically opposite points thereof, and further comprising second latch means and second latch spring means, identical to said first latch means and said first spring means, respectively, whereby said first and second latch means are respectively engaged by the diametrically opposite ends of said latch pin.

6. In a latchable solenoid assembly of the core-plunger type, wherein the plunger is magnetically attracted into the solenoid toward a retracted position upon energization of the solenoid, and wherein a plunger spring biases the plunger out of the solenoid toward an unretracted position, the improvement comprising:

a latch pin fixed to the plunger and projecting outwardly therefrom in a direction transverse to the path of travel thereof;

mechanical latch means mounted in the assembly in the path of travel of said latch pin and fixed against translational movement in a direction parallel to the travel path of said plunger;

said latch means comprising:

a cam plate having a cam surface, a lobe and a slot;

cam spring means biasing said cam plate away from a latched position to an unlatched position when said plunger is in its unretracted position and said solenoid is unenergized;

power supply means for applying electric current to the solenoid to energize it;

said cam surface being positioned for engagement by said latch pin when said latch means is in its unlatched position and when said plunger is magnetically attracted from its unretracted position toward its retracted position upon a first energization of the solenoid, so that said cam plate is moved in a direction against the bias of said cam spring means to the latched position where said lobe engages said latch pin to latch the plunger against return movement toward its unretracted position when the solenoid is subsequently de-energized;

said plunger being again magnetically attracted in a direction into said solenoid upon the next energization of the solenoid so that the latch pin is mechanically moved out of engagement with said lobe and into said slot to permit said cam spring means to return said latch means to its unlatched position whereby, upon subsequent de-energization of said solenoid, said plunger spring returns said plunger toward its unretracted position.

7. The improvement of claim 6 further comprising a camming tab on said cam plate and engaged by said latch pin, when said plunger returns toward its unretracted position, to move said lobe out of the path of said latch pin.

8. A solenoid assembly as defined in claim 1 and further comprising:

12. An optional cap 152 may be secured to the external end of push rod 148.

Thus, the second embodiment illustrated in FIG. 12 is a so-called push-type solenoid, wherein the latching mechanism is located on the rear end of the solenoid assembly, i.e., on the end opposite the working end of the assembly. Of course, the reciprocating movement of the push rod 148 may actuate any suitable utilization device.

Figure 13:
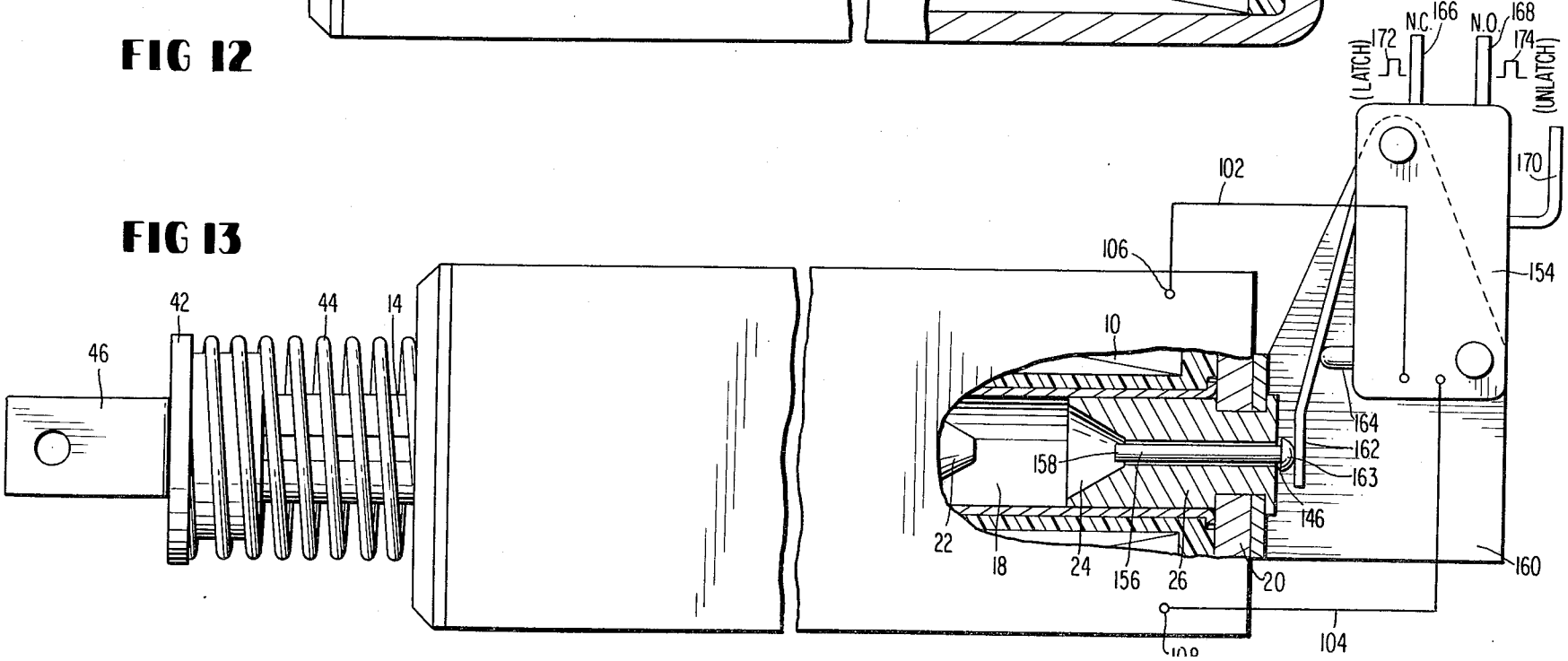
FIG. 13 is a partially cut-away plan view of a third embodiment of the improved solenoid assembly illustrated in FIG. 1.

FIG. 13 is similar to FIG. 1 and illustrates a third embodiment of the invention wherein LATCH and UNLATCH pulses are applied through a positive position switch 154 to energize the solenoid coil 10. Here, a switch actuator rod 156 is slidably mounted within the central bore 146, so that in the illustrated unlatched position of plunger 14 the inner end 158 of the rod projects into the conical recess 24 in the stop member 26. The switch 154 is fixed to the end of frame 20 by a suitable bracket 160 so that the lower end of switch arm 162 just bears against the outer end 163 of the actuator rod 156 when the plunger is in its unlatched, un-energized position. The upper end of switch arm 162 is pivotally mounted to the switch 154, and the intermediate portion of the switch arm engages a spring-loaded switch button 164.

Switch 154 has a latch input terminal 166, an unlatch input terminal 168 and a common input terminal 170. Internally of the switch, the latch input terminal 166 and common terminal 170 are electrically connected across a pair of normally closed (N.C.) contacts, and the unlatched input terminal 168 and common terminal 170 are electrically connected across a pair of normally open (N.O.) contacts.

In this embodiment, separate LATCH and UNLATCH current pulses are generated by a steering circuit or other external control device. In the operation of this embodiment, the plunger is to be moved toward its latched position only upon the appearance of a LATCH pulse 172 across terminals 166 and 170, and to its unlatched, un-energized position only upon the appearance of an UNLATCH pulse 174 across terminals 168 and 170.

The purpose of the switch is to guarantee the proper position of the solenoid plunger during normal sequencing. For example, it would be very troublesome in this embodiment if the normal sequence were disturbed because of an irregular start-up or a power interruption during operation. Without the positive position switch 154, the solenoid assembly would function in a manner exactly opposite to that which is intended.

Under normal operating conditions, the current pulses 172 and 174 are alternately applied to the input terminals 166 and 168. More specifically, if it is assumed that the device is in the unlatched, and un-energized position as illustrated in FIG. 13, a LATCH pulse 172 would first be applied across terminals 166 and 170 to latch the plunger, and then, next, an UNLATCH pulse 174 would be applied across terminals 168 and 170 to unlatch the plunger. Terminal 166 is internally connected to the normally closed (N.C.) contacts, and, thus, the first LATCH pulse 172 would pass through the closed switch contacts to energize the coil, thereby attracting the plunger 14 to the right to its latched position where the conical end 22 of the plunger would engage the end 158 of switch actuator rod 156 to move the switch arm 162 to the right, thereby depressing the switch button 164 to open the normally closed (N.C.) contacts and close the normally open (N.O.) contacts connected to the terminal 168. Thus, if the next pulse which appears is the UNLATCH pulse on terminal 168, the pulse will be passed through to the solenoid to initiate the unlatching operation. However, if the next pulse, instead, were a LATCH pulse on terminal 166, the solenoid would not "see" this pulse as the internal contacts connected to the terminal 166 are held open by the force of the plunger 14 against the switch actuator rod 156. Thus, the positive position switch 154 assures the proper position of the plunger during normal sequencing.

Thus, there has been described above a preferred embodiment of the improved mechanically latchable solenoid of this invention. In addition to being extremely compact and relatively simple compared to prior art devices, the invention also has the following advantages and features. First, the latching mechanism itself is strictly mechanical in the sense that none of its parts is required to be made of magnetizable material, and that both the latching and unlatching operations of the latch are achieved by strictly mechanical forces, rather than by magnetic forces as required in some prior art devices. Even if the latch pin and latch cam are made of magnetic material such as cold-drawn steel, the operation of these parts is not affected by the coil's magnetic field whose minimal magnetic force would not be in the direction to affect the mechanical operation of the latching mechanism. Furthermore, only a single solenoid coil is required, and the coil is energized with current of the same polarity for both latching and unlatching the plunger. Also, the core plunger 14 is a single unitary piece. Furthermore, the design of the latch block and its cavities is such that the two cam plates **74*a* and 74*b*** are identical. Even though the invention has been described as having two cam plates, only one latching mechanism may be required in certain applications, such as those where the side load of the plunger is not very important or where the external force is very low.

I claim:

1. A solenoid assembly having a latchable core plunger and comprising:

a single solenoid coil;

a single-piece core plunger;

means for energizing said solenoid coil with an electric current;

external means normally biasing said plunger to an unretracted position and away from a retracted position;

a latch pin fixed to the plunger and extending therefrom in a direction transverse to the path of travel of the plunger; and mechanical latch means mounted on said solenoid assembly in the path of travel of said latch pin; and latch spring means biasing said latch means to an unlatched position such that, when said solenoid coil is initially energized and said plunger is magnetically attracted to said retracted position, said latch pin mechanically engages said latch means and moves it against the bias of said spring means to a latched position where it engages said latch pin and blocks return movement of the plunger to said unretracted position when said solenoid coil is deenergized, and, when said solenoid coil is next energized, the plunger is again attracted in the direction toward said retracted position so that said latch pin moves out of engagement with said latch means to permit said latch means to return to its push rod means, fixed to one end of said plunger and extending exteriorly of said assembly, for operating an utilization device; and snap ring means, fixed to the exterior portion of said push rod, for engaging said assembly to limit the return movement of said plunger when said coil is unenergized and said plunger is unlatched.

9. A solenoid assembly as defined in claim 1 wherein the outer end of said plunger extends exteriorly of said solenoid assembly, and further comprising means fixed to said outer end for operating an utilization device.

10. A solenoid assembly as defined in claim 9 wherein the inner end of said plunger remains within said solenoid assembly, and wherein said means for energizing said solenoid coil generates LATCH and UNLATCH current pulses, and further comprising:

a switch actuator rod slidably mounted in the end of said assembly adjacent said inner end of said plunger, and extending exteriorly of said assembly; the inner end of said rod being engaged by said inner end of the plunger in said latched position thereof; and positive position switch means mounted on said assembly for mechanical operation by said rod to deliver only LATCH pulses to said solenoid coil when the plunger is in its unretracted unlatched position, and only UNLATCH pulses when the plunger is in its retracted latched position; said switch means being electrically connected between said solenoid coil and said coil-energizing means.

* * * * *